US006558224B2

(12) United States Patent
Chan

(10) Patent No.: US 6,558,224 B2
(45) Date of Patent: May 6, 2003

(54) TOY WITH LIGHT PATTERN

(75) Inventor: Alex Wai Chi Chan, Aberdeen (HK)

(73) Assignee: BEA Development Ltd., Aberdeen (HK)

( * ) Notice: Subject to any disclaimer, the term of this patent is extended or adjusted under 35 U.S.C. 154(b) by 0 days.

(21) Appl. No.: 09/900,745

(22) Filed: Jul. 6, 2001

(65) Prior Publication Data

US 2003/0008595 A1 Jan. 9, 2003

(51) Int. Cl.[7] ..... A63H 33/22
(52) U.S. Cl. ..... 446/219; 446/438; 446/269
(58) Field of Search ..... 446/268, 485, 446/219, 484, 269, 279, 280, 238, 237, 242, 438, 411

(56) References Cited

U.S. PATENT DOCUMENTS 740,817 A * 10/1903 Davis ..... 446/219
1,604,684 A * 10/1926 Evans ..... 446/219
3,579,901 A * 5/1971 Perhacs, Jr. ..... 446/238
3,750,329 A * 8/1973 Zbikowski et al. ..... 446/237
4,209,941 A * 7/1980 Bourque ..... 446/439
4,261,136 A * 4/1981 Tsui ..... 446/270
4,282,680 A * 8/1981 Zaruba ..... 446/270
4,467,554 A * 8/1984 Russell ..... 446/242
4,560,361 A * 12/1985 Cantu ..... 446/237
4,610,637 A * 9/1986 Ferguson ..... 446/237
4,670,820 A * 6/1987 Eddins et al. ..... 446/227
4,813,905 A * 3/1989 Yamaguchi et al. ..... 446/485
4,925,427 A * 5/1990 Wu ..... 446/288
4,929,216 A * 5/1990 Morris et al. ..... 446/272
5,030,160 A * 7/1991 Klawitter ..... 446/242
5,411,429 A * 5/1995 Klawiter ..... 446/242
5,482,493 A * 1/1996 Rapisarda ..... 446/438
5,660,575 A * 8/1997 Chuang ..... 446/409
5,672,090 A * 9/1997 Liu ..... 446/485
6,165,038 A * 12/2000 Muller ..... 446/219
6,171,171 B1 * 1/2001 Barthold ..... 446/219

* cited by examiner

*Primary Examiner*—Derris H. Banks
*Assistant Examiner*—Urszula M Cegielnik
(74) *Attorney, Agent, or Firm*—Wood, Herron & Evans, LLP

(57) ABSTRACT

A toy (2) has a housing (4) at least a part of which is light translucent, a resiliently-mounted light-reflecting member (20) including a plurality of light-reflecting facets, and a light source (40) directed at the light-reflecting member so that a light pattern is reflected onto the housing.

17 Claims, 2 Drawing Sheets

TOY WITH LIGHT PATTERN

BACKGROUND OF THE INVENTION

The present invention relates to a toy.

Toys for young children are required to be eye-catching in order to engage their attention, and preferably include some physical means whereby the child may interact with the mechanism of the toy thereby providing both amusement and assisting in the child's development.

The present invention seeks to provide a toy displaying a light pattern.

SUMMARY OF THE INVENTION

According to the present invention there is provided a toy comprising a housing at least a part of which is translucent, a light-reflective member having light-reflecting surfaces supported within the housing, and a light source directed at the light-reflective member whereby, in use, a light pattern is reflected onto the housing.

This structure is particularly engaging for a child, allowing the child to interact with the light pattern.

In one embodiment the light-reflecting member has a plurality of light-reflecting facets. It may be resiliently supported such as by means of a helical spring, or loosely supported.

The toy may include a plurality of wheels and a rotatable support for the light-reflective member which is operatively connected to at least one of the wheels, whereby rotation of the at least one wheel causes rotation of the light-reflecting member. The wheels may be mounted on a shaft which is operatively connected to the support for the light-reflective member through a gear train. The shaft may support a pair of wheels which are both mounted off-centre on the shaft and off-centre in opposite directions.

BRIEF DESCRIPTION OF THE DRAWINGS

An embodiment of the invention is now described, by way of example only, with reference to the following drawings in which.

DETAILED DESCRIPTION OF THE PREFERRED EMBODIMENT

Figure 2:
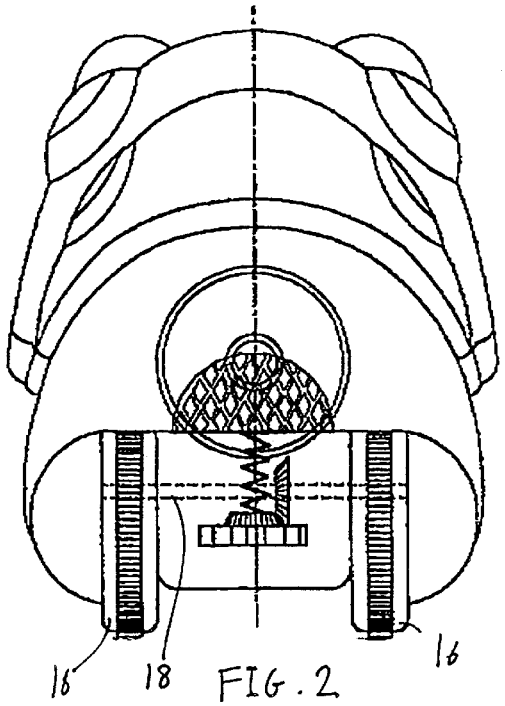
FIG. 2 is a front view of the toy of FIG. 1.
Figure 1:
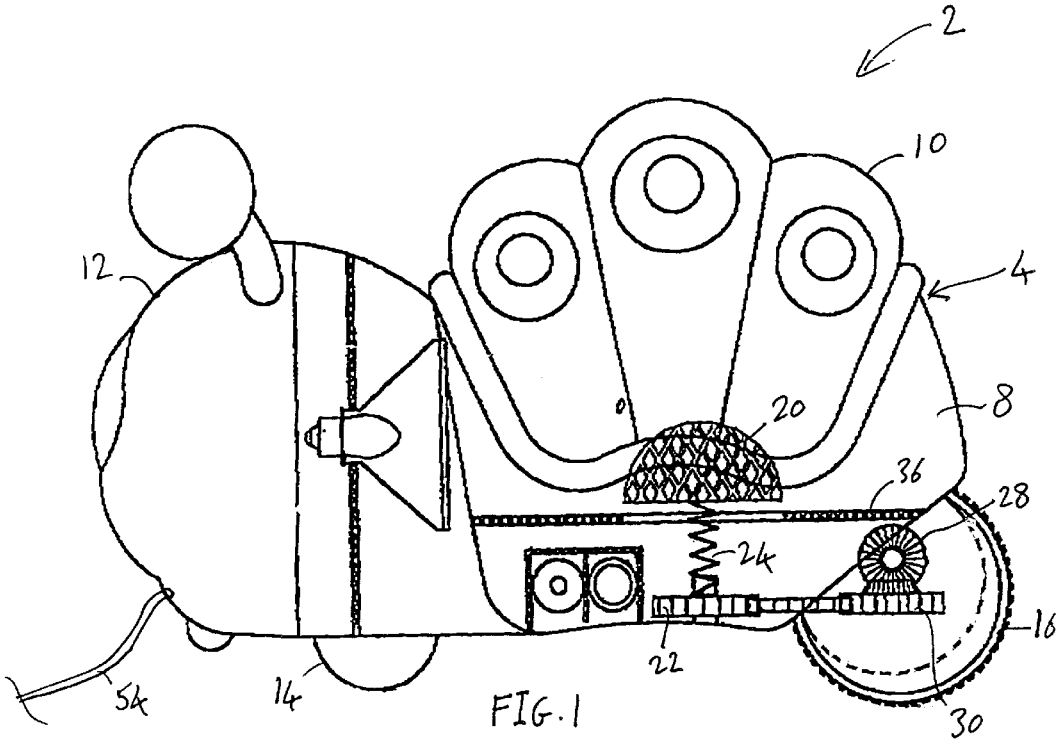
FIG. 1 is a part cut-away side view of a toy in accordance with an embodiment of the invention.
Figure 3:
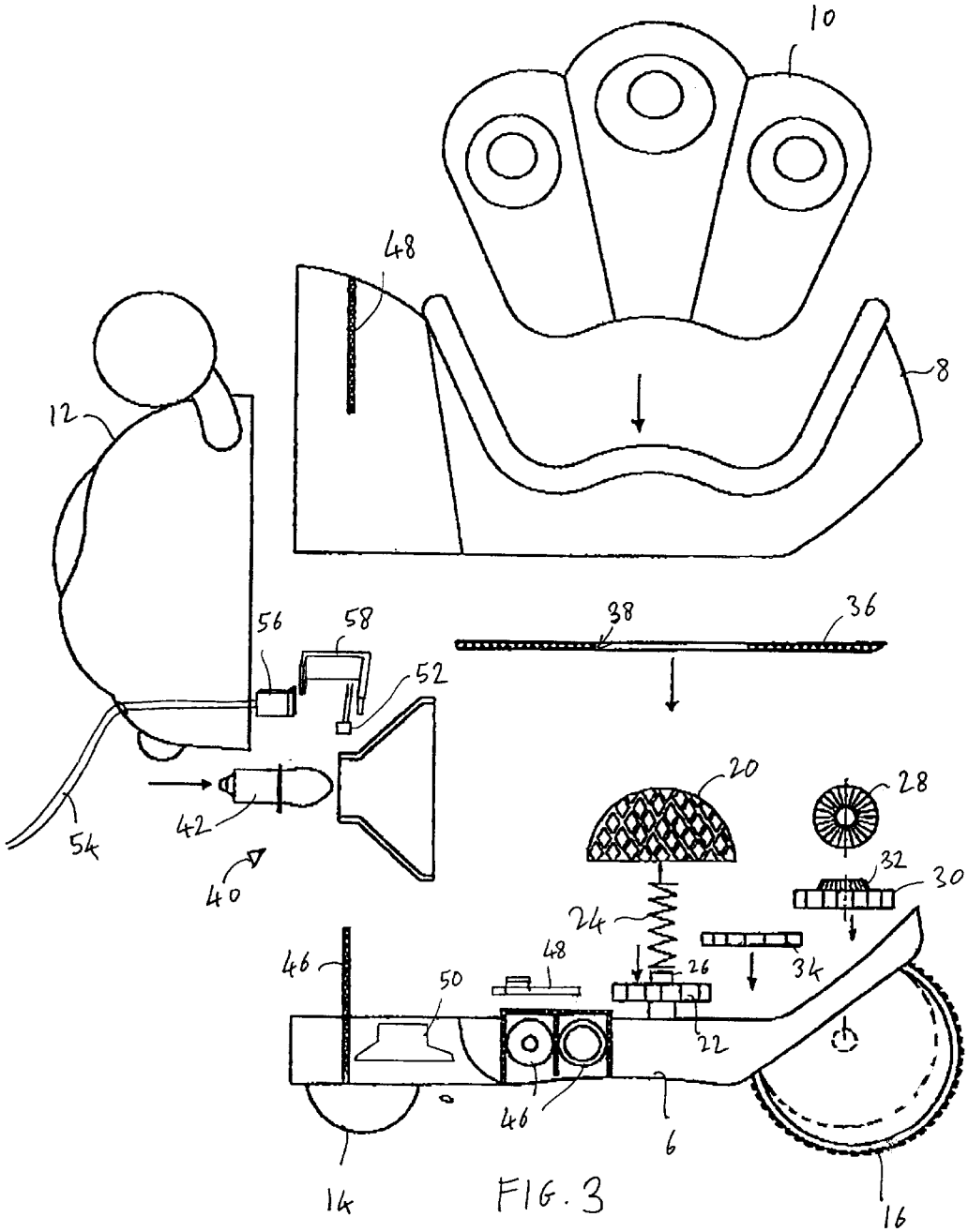
FIG. 3 is an exploded view of the toy.

As shown in FIG. 1, the toy generally indicated 2 has an outer housing 4 shaped here in the form of a snail, but it will be appreciated that any other shape, preferably one which is eye-catching to children, could be utilized. The housing 4 comprises a base part 6 which supports the other parts, main housing 8, an upper housing part 10 and front housing part 12. At least the main housing 8 and upper housing part 10 are preferably formed of translucent plastics material. Supported on the base part 6 are a front wheel 14 and a pair of rear wheels 16, both front and rear wheels having a simple shaft which is rotatably supported on the base, the position of a shaft 18 for the rear wheels being visible in FIG. 2. As can be seen in FIGS. 1 and 3, the rear wheels 16 which are each circular can be mounted off-centre, and the displacement from the wheel centre to the axle may be in different directions such as opposite directions for each wheel. This means that as the toy is propelled by a child it adopts a side to side rocking or "wobbling" motion.

Mounted on the base 6 is a light-reflective member 20 in the form of a hemispherical body covered in small light-reflecting facets in the form of small pieces of silvered glass or plastics. The light-reflecting member 20 is connected to a rotationally mounted gear 22 through a helical spring 24 which makes a push-fit with a projection 26 on top of the gear 22 or a shaft protruding upwardly therefrom, and a projection (not visible) which depends from the underside of the member 20. Although a helical spring 24 is utilized, any other resilient means such as a springy strip could alternatively be employed. Alternatively, the helical spring may be omitted and the light-reflecting member 20 secured directly to the gear 22. In this case the gear 22 may be loosely mounted so that the light-reflecting member may wobble. A gear train comprises a first bevel gear 28 secured on the axle 18, a second gear 30 which has an upper bevelled part 32 which meshes with gear 28, and a third gear 34 meshed with both gears 30 and 22, the gear train providing drive from the shaft 18 to the light-reflecting member 20 so that as the wheels 16 turn the member 20 also rotates.

A horizontal partition 36 is fitted onto the base part 6 to conceal the gear train, having an aperture 38 through which the spring 24 for the light-reflecting member 20 protrudes.

A light source 40 having a bulb 42 and reflector 44 is supported between a lower partition part 46 fitted to the base part 6 and an upper partition part 48 fitted to the main housing 8. Batteries 46 are housed in the base part 6. Also provided is a sound generating means in the form of a sound-generating electronic circuit on a printed circuit board 48 and a speaker 50. A variety of such circuits can be utilised as is well-known to the person skilled in the art. A switch 52 is provided in the form of a pair of thin metallic contacts with the switch 52, bulb 42 and sound generating circuit and bulb 42 arranged in electrical series. The toy 2 is provided with a pulling string 54 which extends through an opening in the front housing part 12 being secured to a first L-shaped connector 56 mounted on the housing so as to allow a small forward and backward movement. The first L-shaped connector 56 is engaged with a second connector 58 having a U-shape likewise normally mounted one end of which engages the first connector 56 and the other end of which bears against the contacts of the switch 52, so that when the child pulls the string 54 to pull the toy along the ground the light source and sound generating means are activated. The light source 40 is directed at the light-reflecting member 20 which reflects a pattern of light in the form of many individual light spots onto the housing, being visible from the outside at least on the translucent main housing 8 and upper housing part 10. As the toy is pulled over the ground by the child the light reflective member 20 rotates as well as making a wobbling movement, whereby a wobbling and rotating light pattern is projected onto and is visible from the outside of the toy creating a particularly eye-catching effect.

What is claimed is:

1. A toy comprising a housing at least a portion of which is translucent, a light-reflecting member having light-reflecting surfaces supported within the housing, and a light source for directing light at the light-reflecting member to reflect a light pattern onto the housing wherein the light-reflecting member is mounted for relative movement within the housing to vary the angle of incidence of the light on the light-reflecting surfaces.

2. A toy according to claim 1 wherein the light-reflecting member has a plurality of individual light-reflecting facets.

3. A toy according to claim 1 further comprising a plurality of wheels and a rotatable support for the light-reflecting member which is operatively connected to at least one of the wheels, whereby rotation of the at least one wheel causes rotation of the light-reflecting member.

4. A toy according to claim 1 wherein the light-reflecting member is supported within the housing for limited relative movement therein.

5. A toy according to claim 1 wherein the light-reflecting member is supported within the housing by a resilient connection.

6. A toy according to claim 5 wherein the resilient connection comprises a helical spring.

7. A toy according to claim 3 wherein said at least one wheel is mounted on a shaft which is operatively connected to the support for the light-reflecting member through a gear train.

8. A toy according to claim 7 wherein the shaft supports a pair of wheels, at least one of the wheels being eccentrically mounted.

9. A toy according to claim 8 wherein both wheels are eccentrically mounted and in an opposite direction to each other.

10. A toy according to claim 1 further comprising sound generating means.

11. A toy according to claim 1 further comprising a pulling string and switch means for the light source operably connected to the pulling string, which switch means are closed on pulling of the toy by the string.

12. A toy comprising:

a housing, at least a portion of which is translucent;

a light source directing light within said housing;

a light-reflecting member supported within said housing for movement to vary the angle of incidence of light falling on said light-reflecting member from said light source;

wherein said light-reflecting member moves in response to movement of the toy.

13. The toy of claim 12, wherein said translucent portion of said housing is stationary relative to said housing.

14. The toy of claim 12, further comprising:

a resilient member coupled to said light-reflecting member, whereby said light-reflecting member is resiliently supported within said housing by said resilient member; and at least one wheel coupled with said housing in an eccentric fashion, whereby rotation of said wheel causes movement of said light-reflecting member on said resilient member.

15. The toy of claim 12, further comprising:

at least one wheel coupled with said housing; and a motion transmission member coupled between said wheel and said light-reflecting member, whereby rotation of said wheel causes movement of said light-reflecting member.

16. The toy of claim 15, wherein said motion transmission member includes at least one gear.

17. A toy comprising:

a housing, at least a part of which is translucent;

a light source directing light within said housing;

a light-reflecting member supported within said housing for movement to vary the angle of incidence of light falling on said light-reflecting member from said lights source;

a resilient member coupled to said light-reflecting member, whereby said light-reflecting member is resiliently supported within said housing by said resilient remember;

at least one wheel coupled with said housing in an eccentric fashion, whereby rotation of said wheel causes movement of said light-reflecting member on said resilient member; and a motion transmission member coupled between said wheel and said light-reflecting member, whereby rotation of said wheel causes movement of said light-reflecting member.

* * * * *

UNITED STATES PATENT AND TRADEMARK OFFICE

CERTIFICATE OF CORRECTION

PATENT NO. : 6,558,224 B2
DATED : May 6, 2003
INVENTOR(S) : Chan

It is certified that error appears in the above-identified patent and that said Letters Patent is hereby corrected as shown below:

Column 4,
Lines 25-26, reads “from said lights source;” and should read -- from said light source; --.

Signed and Sealed this

Seventh Day of October, 2003

JAMES E. ROGAN
*Director of the United States Patent and Trademark Office*